US006915932B1

(12) United States Patent
Wolfe

(10) Patent No.: US 6,915,932 B1
(45) Date of Patent: Jul. 12, 2005

(54) STRAP INCORPORATING A FLUID-FILLED BLADDER

(75) Inventor: Randy S. Wolfe, Beaverton, OR (US)

(73) Assignee: Nike, Inc., Beaverton, OR (US)

( * ) Notice: Subject to any disclaimer, the term of this patent is extended or adjusted under 35 U.S.C. 154(b) by 126 days.

(21) Appl. No.: 10/341,773

(22) Filed: Jan. 13, 2003

(51) Int. Cl.[7] ..... A45F 3/12

(52) U.S. Cl. ..... 224/264; 2/268; 224/608; 224/613

(58) Field of Search ..... 224/264, 607, 224/608, 613; 2/268

(56) References Cited

U.S. PATENT DOCUMENTS

| | | | | |
|---|---|---|---|---|
| 1,444,157 A | | 2/1923 | Lee | |
| 2,304,699 A | * | 12/1942 | Levy | 2/268 |
| 3,883,053 A | * | 5/1975 | Pritchard et al. | 224/264 |
| 5,038,984 A | | 8/1991 | Izzo | |
| 5,294,183 A | | 3/1994 | Wetter et al. | |
| 5,361,957 A | | 11/1994 | Weintraub | |
| 5,435,647 A | | 7/1995 | Oliver | |
| 5,445,858 A | * | 8/1995 | Nwoko | 428/71 |
| 5,566,871 A | | 10/1996 | Weintraub | |
| 5,593,077 A | | 1/1997 | Izzo | |
| 5,626,507 A | * | 5/1997 | Gillen | 2/268 |
| 5,765,735 A | * | 6/1998 | Kimchi et al. | 224/264 |
| 6,109,495 A | | 8/2000 | Hernandez | |
| 6,152,343 A | | 11/2000 | Shin | |
| 6,168,060 B1 | | 1/2001 | Mayers | |
| 6,173,874 B1 | * | 1/2001 | Stein et al. | 224/264 |
| 6,223,959 B1 | | 5/2001 | Chen | |
| D448,170 S | | 9/2001 | Ammerman et al. | |
| 6,471,105 B1 | | 10/2002 | Ammerman et al. | |
| 6,530,129 B1 | * | 3/2003 | Cheng | 224/264 |
| 6,634,923 B2 | * | 10/2003 | Waitz | 2/268 |

FOREIGN PATENT DOCUMENTS

| | | |
|---|---|---|
| EP | 0 898 906 A2 | 3/1999 |
| FR | 2 406 402 | 10/1978 |
| GB | 2 328 604 A | 3/1999 |
| WO | WO 98/17144 | 4/1998 |
| WO | WO-99/58018 A1 * | 11/1999 |
| WO | WO 01/50909 A1 | 7/2001 |

OTHER PUBLICATIONS

Three Photographs of backpack manufactured by NIKE, Inc. and publicly disclosed in 2001.

* cited by examiner

*Primary Examiner*—Gary E. Elkins
(74) *Attorney, Agent, or Firm*—Banner & Witcoff, Ltd.

(57) ABSTRACT

A strap for carrying an article is disclosed and includes a foam element having identations in an outer surface of the foam element. A fluid-filled bladder is positioned within the identations such that a combination of the foam element and the bladder provides cushioning when carrying the article. A resilient cover may be positioned over the bladder to prevent movement of the bladder away from the foam element, and the bladder and foam element may be located within a void formed by a sheath. The foam element may include protrusions located opposite the indentations.

35 Claims, 5 Drawing Sheets

STRAP INCORPORATING A FLUID-FILLED BLADDER

BACKGROUND OF THE INVENTION

1. Field of the Invention

The present invention relates to devices for supporting loads carried by an individual. The invention concerns, more particularly, a support assembly having a strap that incorporates a fluid-filled bladder.

2. Description of Background Art

The formal origins of the game of golf, one of the oldest international sports, dates to the $16^{th}$ century at The Royal and Ancient Golf Club at St. Andrews, located in Scotland. During successive centuries, the game of golf has gained and maintained a populous following due to inherent challenges of the game, a prestigious reputation, and its suitability for relaxation.

Growth in the number of individuals playing the game of golf provides an incentive for manufacturers of golf equipment, which includes golf clubs, balls, and bags, to improve upon the various features and characteristics of the golf equipment. In general, golf equipment has evolved over time to provide enhanced performance and suitability for a wide range of playing abilities and styles. Golf club shafts, for example, were originally fashioned from wood, and are commonly formed of metal or graphite materials today. In addition, golf balls were traditionally formed to include a wound, twine core, but may incorporate a solid core formed of polybutadiene, titanium, nickel, or cobalt, for example. Similarly, advances in golf bags are of particular interest to sporting goods manufacturers, especially with respect to enhancing the comfort of carrying a golf bag containing a full set of clubs and other equipment.

Although motorized carts are commonly utilized for transporting golf equipment and an individual around a golf course, many individuals prefer to walk the length of the golf course, thereby requiring the individual to carry a golf bag laden with the necessary equipment. A golf bag containing an average set of golf clubs, golf balls, and other equipment may weigh in excess of 25 pounds. A conventional golf bag includes, therefore, a support assembly that provides a convenient manner of carrying the golf bag and equipment.

Support assemblies for golf bags may include a single strap that is intended to extend over a shoulder of the individual. Alternately, support assemblies may include dual straps that extend over both shoulders of the individual, thereby providing a manner of carrying the golf bag that is similar to a backpack. U.S. Pat. No. 6,152,343 to Shin and U.S. Pat. Nos. 5,038,984 and 5,593,077 to Izzo provide examples of golf bags with dual straps, and U.S. Pat. No. 6,168,060 to Mayers discloses a strap configuration that may be utilized as a single or dual strap. In addition, some strap configurations incorporate a fluid-filled bladder. For example, U.S. Pat. No. 6,223,959 to Chen discloses a strap for a golf bag having an envelope that encloses an air pocket formed of an inflated thermoplastic material. Similarly, U.S. Pat. Nos. 5,566,871 and 5,361,957 to Weintraub both disclose cushioning devices intended for use in a shoulder strap that incorporate an air-filled member

SUMMARY OF THE INVENTION

The invention is a strap for carrying an article, such as a golf bag or backpack. The strap includes a foam element and a fluid-filled bladder. The foam element has an outer surface that forms at least one indentation, and the bladder is received by the indentation. The strap may also include a cover and a sheath. The cover extends over the bladder to prevent outward movement of the bladder in relation to the foam element, and the sheath extends around the foam element, the bladder, and the cover.

The strap, in accordance with one embodiment, has an elongate shape such that the foam element forms a series of indentations positioned linearly along the length of the strap. The bladder has a corresponding configuration that includes a series of chambers connected by conduits, with the chambers being received by the indentations. The cover extends over the bladder and may include apertures that expose a portion of each chamber. The foam element may also include a series of protrusions formed in a surface opposite the indentations. That is, each protrusion is located opposite a corresponding indentation and chamber.

When utilized to support the article, the strap is generally positioned over a shoulder of an individual such that the weight of the article is supported by the shoulder and a combination of the foam element and the bladder provides cushioning. When protrusions are formed in the foam element, the protrusions may be positioned to engage the shoulder and enhance the cushioning effect of the foam element. Accordingly, the protrusions may be formed on a weight-bearing surface of the strap to thereby contact the shoulder of the individual. The combination of the bladder with the structure of the foam element distribute the weight of the article over the surface area of the shoulder to reduce the occurrence of pressure points.

The advantages and features of novelty characterizing the present invention are pointed out with particularity in the appended claims. To gain an improved understanding of the advantages and features of novelty, however, reference may be made to the following descriptive matter and accompanying drawings that describe and illustrate various embodiments and concepts related to the invention.

DESCRIPTION OF THE DRAWINGS

The foregoing Summary of the Invention, as well as the following Detailed Description of the Invention, will be better understood when read in conjunction with the accompanying drawings.

DETAILED DESCRIPTION OF THE INVENTION

The following discussion and accompanying figures disclose an article having a support assembly with a pair of straps in accordance with the present invention. The article is a carry-style golf bag and the support assembly is disclosed in connection with the golf bag in order to demonstrate one possible manner in which the present invention may be incorporated into a commonly-utilized article. The concepts disclosed in the following discussion may, however, be applied to straps that are utilized with a plurality of other articles, including backpacks and other styles of golf bag, for example.

Figure 1:
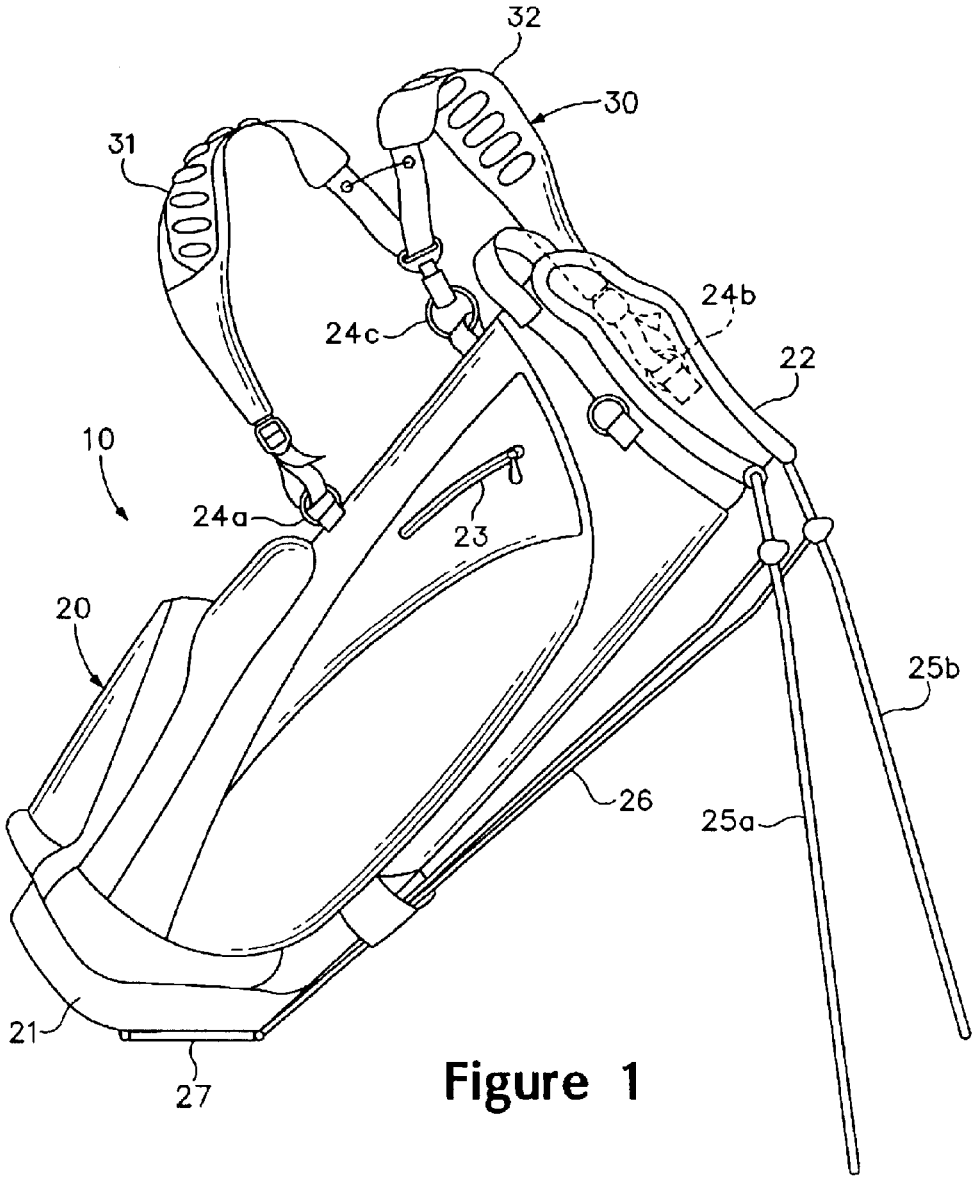
FIG. 1 is an perspective view of an article having a support assembly that includes a first strap and a second strap in accordance with the present invention.
Figure 2:
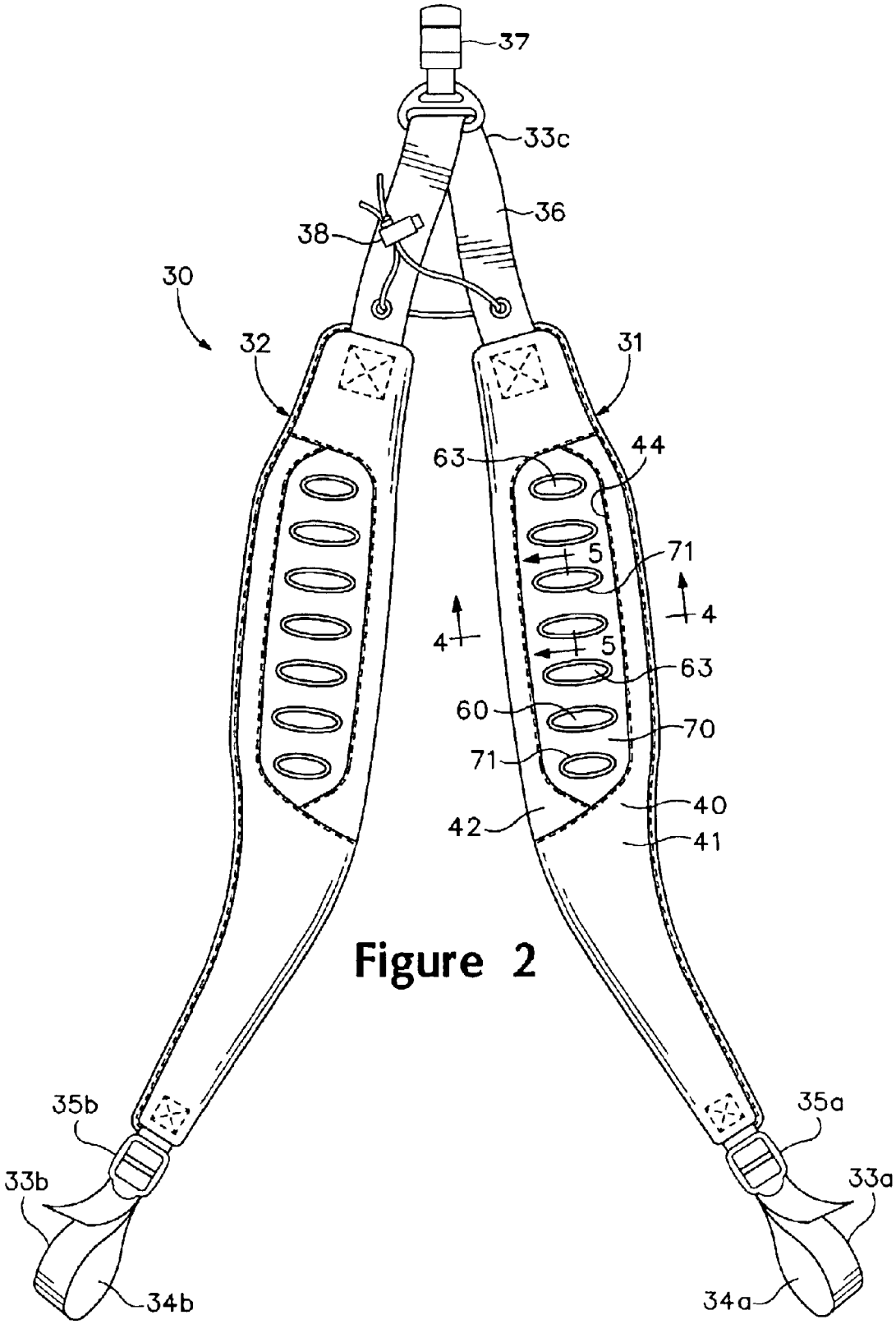
FIG. 2 is a top plan view of the support assembly.
Figure 3:
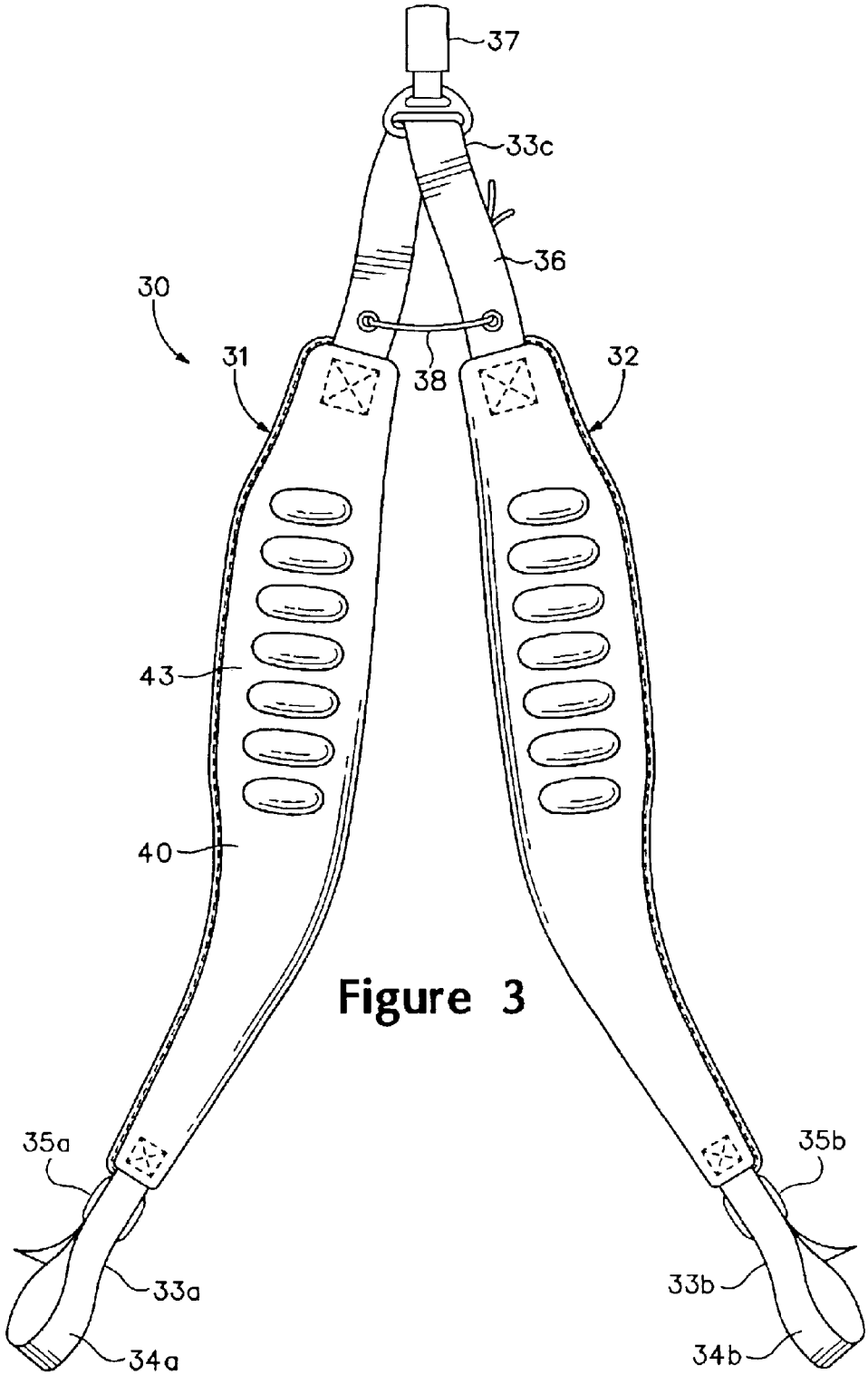
FIG. 3 is a bottom plan view of the support assembly.
Figure 4:
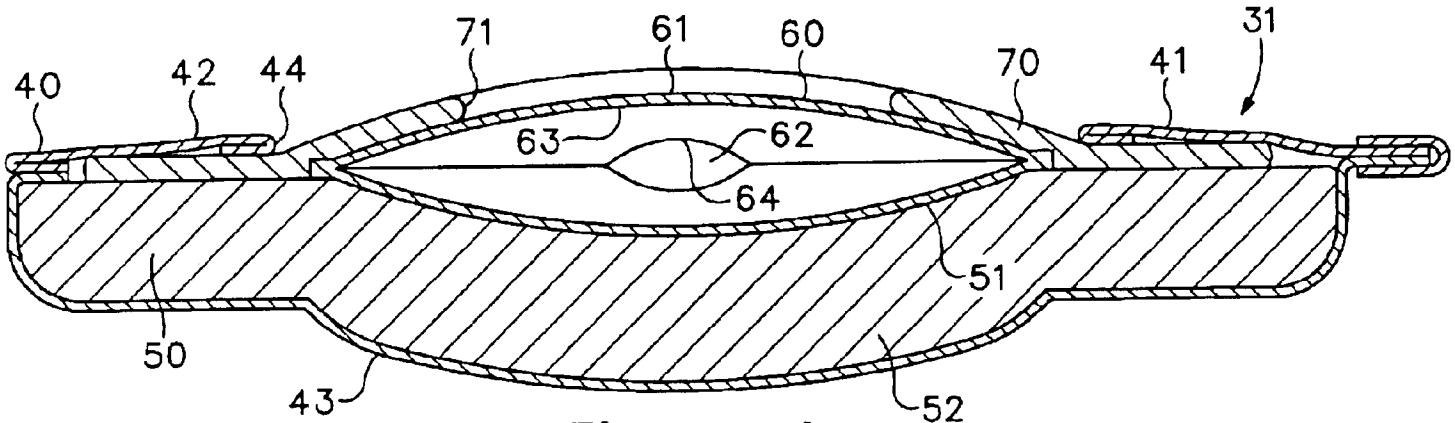
FIG. 4 is a first cross-section of the first strap, as defined by line 4—4 in FIG. 2.
Figure 5:
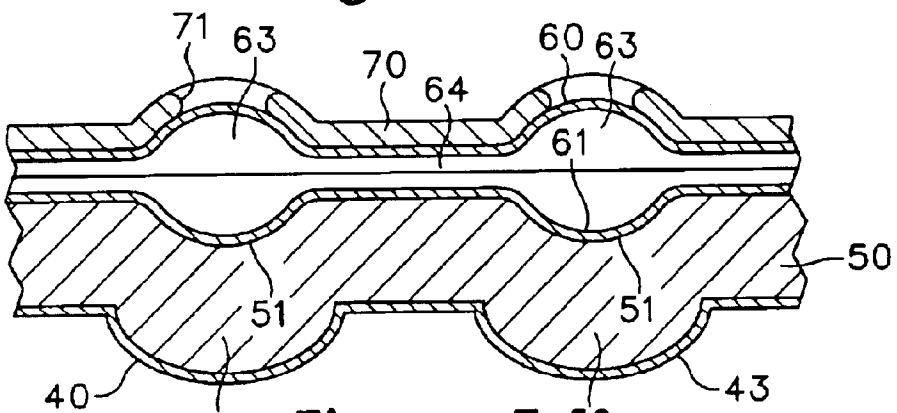
FIG. 5 is a second cross-section of the first strap, as defined by line 5—5 in FIG. 2.

A golf bag 10 suitable for transporting various types of equipment utilized in the game of golf is depicted in FIG. 1. The primary elements of golf bag 10 are a generally tubular body 20 and a support assembly 30. Body 20 includes a closed base 21, an open upper end 22, a variety of pockets 23, and at least three connection points 24*a*–24*c*. Upper end 22 is configured to receive a plurality of golf clubs such that shafts of the golf clubs extend through the interior of body 20 and heads of the golf clubs are accessible from upper end 22. Golf balls, towels, tees, and other equipment may also be stored within pockets 23. As will be described in the following material, support assembly 30 is securely attached to connection points 24*a*–24*c*, thereby joining support assembly 30 with body 20.

Body 20 also includes a pair of legs 25*a* and 25*b*, an actuator 26, and a base plate 27. The primary purpose of legs 25*a* and 25*b* is to provide golf bag 10 with support when in an inclined position, as depicted in FIG. 1. Legs 25*a* and 25*b* are pivotally-mounted adjacent to upper end 22. In an upright position (not depicted) legs 25*a* and 25*b* extend along the outer surface of body 20. In the inclined position, however, legs 25*a* and 25*b* extend outward from body 20 to provide support. Actuator 26 is attached to each of legs 25*a* and 25*b* and extends downward along the exterior of body 20 to connect with a first side of base plate 27. A second side of base plate 27 is pivotally-attached to base 21 such that base plate 27 pivots toward base 21 when legs 25*a* and 25*b* extend outward from body 20. Accordingly, base plate 27 provides a flat surface for golf bag 10 to rest upon in both the upright position and the inclined position.

Support assembly 30 includes a first strap 31 and a second strap 32 that provide a structure for comfortably carrying golf bag 10 and the equipment stored within golf bag 10. Straps 31 and 32 are utilized in a manner that is generally analogous to the straps of a backpack. That is, straps 31 and 32 are positioned to extend over opposite shoulders of the individual when carrying golf bag 10, thereby distributing the weight of golf bag 10 between the shoulders. Each of straps 31 and 32 supports, therefore, a percentage of the weight of golf bag 10. The specific percentage of support provided by first strap 31 and second strap 32 depends, however, upon the particular configuration of straps 31 and 32, the positions of connection points 24*a*–24*c*, and the manner in which golf equipment is placed within body 20.

Support assembly 30 is designed, as described above, such that both straps 31 and 32 may be simultaneously utilized in carrying golf bag 10 and the equipment located within body 20. In an alternative method of carrying golf bag 10, the individual may utilize only one of first strap 31 and second strap 32. That is, the individual may place first strap 31, for example, over one of the shoulders when carrying golf bag 10. The entirety of the weight of golf bag 10 is then supported by first strap 31 and one of the shoulders. Similarly, golf bag 10 may be carried by placing second strap 32 over one of the shoulders.

Support assembly 30 is secured to body 20 at connection points 24*a*–24*c*. A connector 33*a* extends from an end of first strap 31 and is configured to join with connection point 24*a*. A connector 33*b* extends from an end of second strap 32 and is configured to join with connection point 24*b*. Similarly, a connector 33*c* extends between opposite ends of first strap 31 and second strap 32 and is configured to join both straps 31 and 32 with connection point 24*c*.

Connection points 24*a*–24*c* are rings that are fastened at various locations along body 20. Connector 33*a* includes an element of webbing 34*a* that extends through connection point 24*a* and forms a loop that is secured with a friction buckle 35*a*. By sliding friction buckle 35*a* relative to webbing 34*a*, the effective length of first strap 31 may be adjusted to suit the specific preferences of the individual. Connector 33*b* has a similar configuration that includes an element of webbing 34*b* and a friction buckle 35*b*. Connector 33*c* is depicted having an element of webbing 36 that extends between both straps 31 and 32 and includes a hook 37 located at an approximate midpoint of webbing 36, with hook 37 being secured to the ring at connection point 24*c*. Connector 33*c* also includes a retainer 38 that is secured to webbing 36 adjacent to first strap 31 and second strap 32, thereby limiting the degree of separation of webbing 36 adjacent to straps 31 and 32.

The specific configuration of connection points 24*a*–24*c* and connectors 33*a*–33*c* may vary significantly within the scope of the present invention to include any connection system suitable for securing support assembly 30 to body 20. Accordingly, the configuration depicted in the figures is intended to be one example of a suitable connection system. Other connection systems may also be utilized. For example, straps 31 and 32 may be permanently attached to body 20 at connection points 24*a*–24*c*; connector 33*c* may include two separate elements of webbing that are secured to connection point 24*c*; or each of connectors 33*a* and 33*b* may include a hook that engages connection points 24*a* and 24*b*, respectively. Accordingly, the specific manner in which support assembly 30 is secured to body 20 may vary within the scope of the present invention to include other suitable connection systems.

The structure of first strap 31 is substantially similar to the structure of second strap 32. Accordingly, the following discussion will focus upon first strap 31, with an understanding that the concepts and features disclosed with respect to first strap 31 also apply to second strap 32. First strap 31 has a generally elongate shape and includes a sheath 40, a foam element 50, a fluid-filled bladder 60, and a cover 70. Sheath 40 extends around foam element 50, bladder 60, and cover 70 to secure the relative positions of the various components and provide a durable, wear-resistant outer surface for first strap 31. Foam element 50 and bladder 60 are located within sheath 40 and cooperatively provide cushioning that comfortably distributes the weight of golf bag 10 over the surface of the shoulder. Cover 70 is positioned over foam element 50 and bladder 60 to provide a resilient member that limits the degree of stretch in first strap 31 and limits outward movement of bladder 60 in relation to foam element 50.

Sheath 40 may be formed from an individual element or a plurality of elements that are sewn together to form an exterior for first strap 31. As depicted in FIGS. 1–5, however, sheath 40 is formed from a first upper element 41, a second upper element 42, and a lower element 43. Upper elements 41 and 42 form a central opening 44 that exposes portions of bladder 60 and cover 70. Lower element 43 is sewn to upper elements 41 and 42 around the periphery of first strap 31 to form an interior void for receiving foam element 50, bladder 60, and cover 70. Suitable materials for sheath 40 generally include natural or synthetic textiles, polymer sheets, or leather materials. In order to provide aesthetic uniformity between first strap 31 and golf bag 10, sheath 40 may be fashioned from the materials that form body 20. Connectors 33*a* and 33*c* may be directly attached to sheath 40, through stitching, for example. Sheath 40 is secured to the outer surface of foam element 50, and may be bonded to foam element 50 through a heat bonding operation or an adhesive, for example.

Figures 6A, 6B, 7:
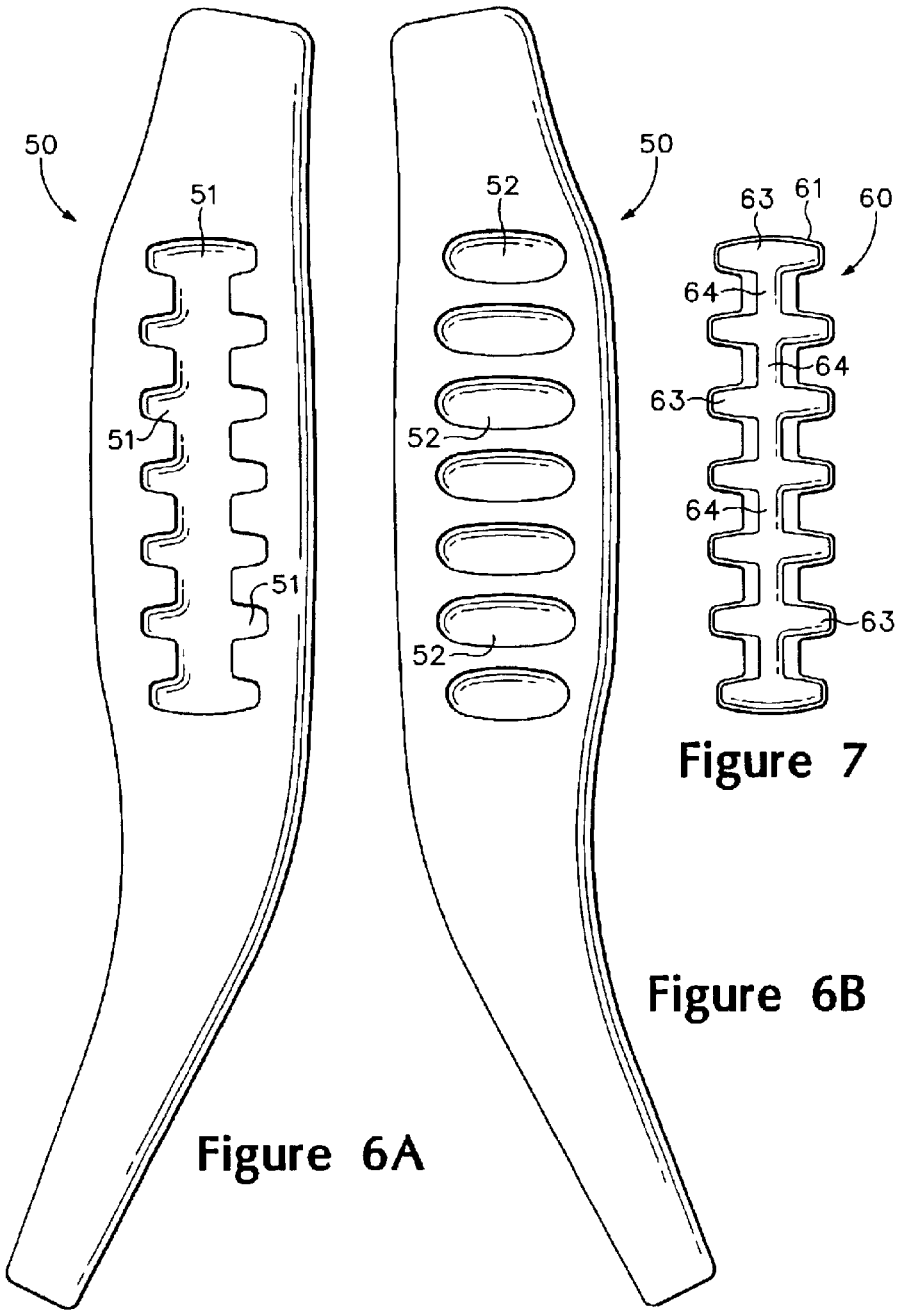
FIG. 6A is a plan view depicting an upper surface of a foam element located within the first strap.
FIG. 6B is a plan view depicting a lower surface of the foam element.
FIG. 7 is a plan view of a bladder located within the first strap.

Foam element 50 is depicted individually in FIGS. 6A and 6B and has a generally elongate configuration. With respect to support assembly 30, foam element 50 extends along at least a portion of a length of first strap 31 and is positioned below bladder 60 and cover 70. An upper surface of foam element 50 includes indentations 51, which are arranged in a linear configuration and receive portions of bladder 60. In addition, a lower surface of foam element 50 includes protrusions 52 that correspond in location with indentations 51. The dimensions of indentations 51 may be approximately equivalent to the dimensions of protrusions 52 such that foam element 50 has a substantially uniform thickness. Suitable materials for foam element 50 include a variety of polymer foams, such as polyurethane or ethylvinylacetate foam materials. In addition, foam element 50 may be formed from foam materials conventionally utilized within personal flotation devices, such as life vests. Accordingly, foam element 50 may be formed from molded ethyl vinyl acetate. Another suitable material for foam element 50 is molded polyurethane foam.

Bladder 60 is depicted individually in FIG. 7 and is located between foam element 50 and cover 70. The primary elements of bladder 60 are an outer envelope 61 that encloses a fluid 62. Envelope 61 forms a plurality of chambers 63 that are linearly connected by a plurality of conduits 64. Chambers 63 are in fluid communication such that fluid 62 may flow from a first chamber 63 to an adjacent second chamber 63 through the conduit 64 that connects the first and second chambers 63. In an alternate embodiment, chambers 63 may be sealed from fluid communication with each other. With respect to foam element 50, chambers 63 are located within indentations 51.

Strap 31 is intended to extend over the shoulder during use, which requires bending in strap 31. The structure of bladder 60, particularly the plurality of chambers 63 connected by conduits 64, provides a structure that facilitates flexing in multiple directions. Accordingly, bladder 60 bends at conduits 64 to provide such overall flexibility.

Envelope 61 may be formed of a polymer material, such as a thermoplastic elastomer, that is substantially impermeable to fluid 62. More specifically, the material forming envelope 61 may be, for example, a film formed of alternating layers of thermoplastic polyurethane and ethylene-vinyl alcohol copolymer, as disclosed in U.S. Pat. Nos. 5,713,141 and 5,952,065 to Mitchell et al, which is hereby incorporated by reference. A variation upon this material wherein the center layer is formed of ethylene-vinyl alcohol copolymer; the two layers adjacent to the center layer are formed of thermoplastic polyurethane; and the outer layers are formed of a regrind material of thermoplastic polyurethane and ethylene-vinyl alcohol copolymer may also be utilized for envelope 61. Another suitable material is a flexible microlayer membrane that includes alternating layers of a gas barrier material and an elastomeric material, as disclosed in U.S. Pat. Nos. 6,082,025 and 6,127,026 to Bonk et al., which are also hereby incorporated by reference. Other suitable thermoplastic elastomer materials or films include polyurethane, polyester, polyester polyurethane, polyether polyurethane, such as cast or extruded ester-based polyurethane film. Additional suitable materials are disclosed in U.S. Pat. Nos. 4,183,156 and 4,219,945 to Rudy. Among the numerous thermoplastic urethanes that are suitable for forming envelope 61 are urethanes such as PELLETHANE, a product of the Dow Chemical Company; ELASTOLLAN, a product of the BASF Corporation; and ESTANE, a product of the B.F. Goodrich Company, all of which are either ester or ether based. Still other thermoplastic urethanes based on polyesters, polyethers, polycaprolactone, and polycarbonate macrogels may be employed. Nitrogen blocking barrier materials may also be utilized. Further suitable materials include thermoplastic films containing a crystalline material, as disclosed in U.S. Pat. Nos. 4,936,029 and 5,042,176 to Rudy, hereby incorporated by reference, and polyurethane including a polyester polyol, as disclosed in U.S. Pat. Nos. 6,013,340; 6,203,868; 6,321,465; and 6,391,405 to Bonk et al., also incorporated by reference.

The fluid contained by bladder 60 may vary to include any of the disclosed fluids in U.S. Pat. No. 4,340,626 to Rudy, such as hexafluoroethane and sulfur hexafluoride, for example. In addition, bladder 60 may include nitrogen gas or air at a desired pressure level. In some applications, the pressure of the gas contained by bladder 60 may be at ambient pressure. In addition, a pump system may be employed that permits the individual to selectively pressurize bladder 60 to a desired pressure.

Cover 70 is located above bladder 60 and includes a plurality of apertures 71 that permit portions of bladder 60 to protrude outward. The areas of cover 70 immediately surrounding apertures 71 may be raised to provide areas for receiving each of chambers 63. In order to retain foam element 50 and bladder 60 within sheath 40, cover 70 may be stitched or otherwise attached to upper elements 41 and 42. Suitable materials for cover 70 include rubber, elastomeric rubber, or other flexible polymer materials.

The configuration of first strap 31 described above provides a comfortable structure for contacting the shoulder of the individual and supporting relatively heavy loads, such as golf bag 10 and the equipment located within golf bag 10. Whereas many golf bag straps incorporate a foam material, first strap 31 incorporates both foam element 50 and bladder 60 to provide cushioning. That is, foam element 50 and bladder 60 cooperatively provide a comfortable cushioning structure for supporting and carrying golf bag 10 or any other supported item. Furthermore, foam element 50 and bladder 60 cooperatively distribute the weight of golf bag 10 over the surface area of the shoulder, thereby decreasing the incidence of pressure points.

The manner in which first strap 31 provides cushioning is unique to the structure of foam element 50 and bladder 60. As discussed above, foam element 50 includes indentations 51 that receive chambers 63. When strap 31 is placed over the shoulders of the individual, the portion of sheath 40 extending over a lower surface of foam element 50 provides the primary point of contact between strap 31 and the individual. Accordingly, the application of a downward force, which is supplied by body 20 and the golf equipment, compresses foam element 50 against the shoulders. If the downward force is relatively small, foam element 50 provides a majority of the cushioning. If the downward force is relatively large, however, both foam element 50 and bladder 60 will compress such that cushioning is provided through a combination of foam element 50 and bladder 60. Accordingly, the structure of strap 31 provides a two-stage cushioning effect, wherein initial cushioning is primarily provided by foam element 50, and subsequent cushioning is provided by a combination of foam element 50 and bladder 60. Cover 70 also contributes to the cushioning effect of strap 31 by preventing significant outward movement of bladder 60 relative to foam element 50, thereby retaining bladder 60 within indentations 51.

Indentations 51 promote cushioning by integrating bladder 60 into foam element 50. If, for example, foam element 50 had a planar upper surface and bladder 60 merely rested upon the upper surface, then a majority of the cushioning would be provided by foam element 50, with bladder 60 contributing little or no cushioning. As described herein, however, bladder 60 is received by indentations 51, thereby integrating bladder 60 into foam element 50 such that cushioning is cooperatively provided by foam element 50 and bladder 60.

Protrusions 52 are positioned on a lower, weight-bearing surface of strap 31 that contacts the shoulder when worn by the individual, and also promote the cushioning provided by first strap 31. When strap 31 is placed over the shoulder, protrusions 52 are located adjacent to the surface of the shoulder and compresses against the shoulder. More specifically, the application of a downward force compresses protrusions 52, thereby compressing localized areas of foam element 50. As discussed above, the locations of protrusions 52 correspond with the locations of indentations 51 and chambers 63. As the downward force is increased, therefore, the degree of compression in the areas of protrusions 52 is greater than in other areas of foam element 50. The areas of greatest compression are, therefore, located proximal to chambers 63 of bladder 60. Accordingly, a greater percentage of the downward force acts upon bladder 60, thereby enhancing the degree of cushioning provided by a combination of foam element 50 and bladder 60.

The preceding discussion focused primarily upon golf bag 10, which incorporates a support assembly 30 that includes a pair of straps 31 and 32. The various concepts disclosed with respect to golf bag 10, and particularly straps 31 and 32, may be applied to a variety of other articles. For example, cart-style golf bags and tour-style golf bags commonly include a single strap, which may have a configuration similar to one of straps 31 and 32. The various concepts of the present invention may also be applied to articles other than golf bags, such as backpacks that include two separate straps, which may also have a configuration similar to the configuration of straps 31 and 32. In addition, articles such as messenger bags and notebook computer bags, which utilize a single strap, may benefit from a strap configuration similar to straps 31 and 32. The concepts disclosed in the preceding discussion may, therefore, be applied to support assemblies for a wide range of articles in order to provide an individual with a comfortable manner of carrying the article.

The present invention is disclosed above and in the accompanying drawings with reference to a variety of embodiments. The purpose served by the disclosure, however, is to provide an example of the various features and concepts related to the invention, not to limit the scope of the invention. One skilled in the relevant art will recognize that numerous variations and modifications may be made to the embodiments described above without departing from the scope of the present invention, as defined by the appended claims.

That which is claimed is:

1. A strap for carrying an article, said strap comprising a foam element and a fluid-filled bladder, said foam element having an outer surface that forms at least one indentation, a first portion of said bladder being received by said at least one indentation, and a second portion of said bladder that is located opposite said indentation being exposed.

2. The strap of claim 1, wherein said foam element includes at least one protrusion located opposite said at least one indentation.

3. The strap of claim 2, wherein said at least one protrusion is positioned on a weight-bearing surface of said strap.

4. The strap of claim 1, further including a cover, said bladder being located between said cover and said foam element.

5. The strap of claim 4, wherein said cover is formed of a resilient material that limits movement of said bladder away from said foam element.

6. The strap of claim 1, further including a sheath that extends at least partially around said foam element and said bladder.

7. The strap of claim 6, wherein said sheath is at least partially formed of a textile material.

8. A strap for carrying an article, said strap comprising:

a foam element having a first surface and an opposite second surface, said foam element including a plurality of indentations formed in said first surface; and a fluid-filled bladder located adjacent to said first surface, said bladder extending into at least one of said indentations.

9. The strap of claim 8, wherein said foam element includes a plurality of protrusions formed in said second surface and opposite said indentations.

10. The strap of claim 9, wherein said second surface is a weight-bearing surface of said strap.

11. The strap of claim 8, wherein said bladder is configured to have a plurality of chambers connected by conduits, at least a portion of said chambers being received by said indentations.

12. The strap of claim 11, wherein said indentations and said chambers are arranged in a linear configuration along a length of said strap.

13. The strap of claim 11, wherein said chambers are in fluid communication through said conduits.

14. The strap of claim 11, further including a cover, said bladder being located between said cover and said foam element, said cover defining a plurality of apertures positioned to expose areas of said chambers.

15. A strap for carrying an article, said strap comprising:

a foam element having a first surface and an opposite second surface, said foam element including a plurality of indentations formed in said first surface, and said foam element including a plurality of protrusions formed in said second surface, at least a portion of said protrusions being located opposite at least a portion of said indentations;

a fluid-filled bladder located adjacent to said first surface, said bladder including a plurality of chambers, at least a portion of said chambers being located within said indentations; and a cover positioned over said bladder and opposite said foam element, said cover defining a plurality of apertures that expose said chambers.

16. The strap of claim 15, further including a sheath that extends at least partially around said foam element, said bladder, and said cover.

17. the strap of claim 16, wherein said sheath defines an opening, said cover being located in said opening.

18. The strap of claim 16, wherein said sheath is at least partially formed of a textile material.

19. The strap of claim 15, wherein said chambers are placed in fluid communication through a plurality of conduits.

20. The strap of claim 15, wherein said second surface is a weight-bearing surface of said strap.

21. A support assembly comprising:

a first strap and a second strap having an elongate configuration, at least said first strap including a foam element and a fluid-filled bladder, said foam element having a surface that forms a plurality of indentations, said bladder being located adjacent said surface, and said bladder being received by at least one of said indentations;

a first connector extending from a first end of said first strap, said first connector being configured to join with a first connection point on an article;

a second connector extending from a first end of said second strap, said second connector being configured to join with a second connection point on the article; and a third connector extending from a second end of said first strap and extending from a second end of said second strap, said third connector being configured to join with a third connection point on the article.

22. The support assembly of claim 21, wherein said foam element includes a plurality of protrusions formed in another surface and opposite said indentations.

23. The support assembly of claim 21, wherein said protrusions are located on a weight-bearing surface of said first strap.

24. The strap of claim 21, wherein said bladder is configured to have a plurality of chambers connected by conduits, at least a portion of said chambers being received by said indentations.

25. The strap of claim 23, wherein said indentations and said chambers are arranged in a linear configuration.

26. The strap of claim 23, wherein said chambers are in fluid communication through said conduits.

27. The strap of claim 23, further including a cover, said bladder being located between said cover and said foam element, said cover defining a plurality of apertures that expose portions of said chambers.

28. A strap for carrying an article, said strap comprising a foam element and a fluid-filled bladder, said foam element having an outer surface that forms at least one indentation, at least a portion of said bladder being received by said at least one indentation, the strap further including a cover having an aperture that exposes a portion of said bladder, said bladder being located between said cover and said foam element.

29. The strap of claim 28, wherein said cover is formed of a resilient material that limits movement of said bladder away from said foam element.

30. A strap for carrying an article, said strap comprising a foam element and a fluid-filled bladder, said foam element having an outer surface that forms a plurality of indentations in said foam element, at least a portion of said bladder being received by said plurality of indentations.

31. The strap of claim 30, wherein said bladder is configured to have a plurality of chambers connected by conduits, said plurality of chambers being received by said plurality of indentations.

32. The strap of claim 31, wherein said plurality of indentations and said plurality of chambers are arranged in a linear configuration.

33. The strap of claim 31, wherein said plurality of chambers are in fluid communication through said conduits.

34. The strap of claim 31, wherein said foam element includes a plurality of protrusions located opposite said plurality of indentations.

35. The strap of claim 31, further including a cover, said bladder being located between said cover and said foam element, said cover defining a plurality of apertures.

* * * * *